US006549739B2

(12) United States Patent
Dettinger et al.

(10) Patent No.: US 6,549,739 B2
(45) Date of Patent: Apr. 15, 2003

(54) DEVICE FOR MANUAL REPLACEMENT OF THE ROLLER OF A COPYING MACHINE

(75) Inventors: Karl-Heinz Dettinger, Ebersbach (DE); Andreas Konday, Deggingen (DE); Timo Straub, Geislingen (DE); Markus Weber, Aichwald (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/850,461

(22) Filed: May 7, 2001

(65) Prior Publication Data

US 2002/0009307 A1 Jan. 24, 2002

(30) Foreign Application Priority Data

May 15, 2000 (DE) ..... 100 23 614

(51) Int. Cl.[7] ..... G03G 15/00

(52) U.S. Cl. ..... 399/122; 219/216; 399/107; 399/122

(58) Field of Search ..... 399/107, 116, 399/117, 121, 122, 123; 219/216

(56) References Cited

U.S. PATENT DOCUMENTS 5,301,000 A * 4/1994 Heigi ..... 219/216

* cited by examiner

*Primary Examiner*—Hoang Ngo
(74) *Attorney, Agent, or Firm*—Lawrence P. Kessler

(57) ABSTRACT

The invention relates to a device for manual replacement of a roller (1) of a copying machine, the roller being equipped with carrying means, in which it can turn freely around its center axis (X1), and the machine (F) on the one hand having rollers (1; 2) in a roller pair arrangement for routing through and delivering a recording medium (S) in the form of a sheet or strip, which rollers can be operated in rotation in an adjoining, axially parallel arrangement in the bearing points (L1; L2; L3; L4) of the machine, and are supported by their axial ends, and on the other hand there being manually activated means for releasing/fixing the rollers in their bearing points and for separating/compressing (3) the rollers in the radial direction for purposes of removing them from and inserting them into their bearing points. To arrive at a device which makes it safer and easier to carry out customer service of the machine, especially replacement and deposition of heavy and large rollers, and which moreover has a simple, compact, economical structure, the roller (1) has on its two axial ends one carrying handle (T1; T2) each as the carrying means which is located eccentrically to the center axis (X1) of the roller such that the roller hangs down vertically underneath the carrying handles due to its weight in the manual removal from and insertion into the input/output openings of the bearing points (L1; L2) of the machine, which openings run vertically and radially.

8 Claims, 4 Drawing Sheets

DEVICE FOR MANUAL REPLACEMENT OF THE ROLLER OF A COPYING MACHINE

FIELD OF THE INVENTION

The invention relates to a device for manual replacement of a roller of a copying machine and more particularly to a device for manual replacement of a copying machine fuser roller.

BACKGROUND OF THE INVENTION

Copying machines are known in the form of copiers in which a roller is replaceable for service purposes, the roller being equipped with a carrying feature, in which it can turn freely around its center axis. The copying machine has rollers, in a roller pair arrangement, for routing and delivering a toner image-bearing recording medium in the form of a sheet or strip. The rollers are supported at their axial ends and are operated in rotation in an adjoining, axially parallel arrangement in bearing points of the copying machine. There are manually activated mechanisms for releasing the rollers in their bearing points, and for separating the rollers in the radial direction for purposes of removing them from, and inserting them into, their bearing points.

U.S. Pat. No. 4,121,089 discloses a copier machine, in which the fixing unit for toner image-bearing sheets of paper can be removed laterally from the copier for service purposes and has a mechanism in the form of a manually actuated swiveling lever system for release of the fixer/heating roller. The fixing/heating roller moreover has carrying features, for its replacement and carrying. The carrying feature is in the form of a single U-shaped carrying handle which is located rigidly on a U-shaped holding frame spaced in the middle between the axial ends of the fixing/heating roller and radially to the center axis of the roller. The U-shaped holding frame, on its free U-leg ends, has one pivot bearing each for one of the axial shaft ends of the roller in which it can be freely turned. Moreover, the holding frame, on the outside, on its free U-leg ends, has cube-shaped, separate bearing blocks which are connected rigidly to the leg ends. The fixing/heating roller can be inserted/removed into/from the U-shaped bearing points of the fixing unit by the cube-shaped separate bearing blocks. The pressure roller, which is located obliquely underneath the fixing/heating roller, does not have any carrying handles and can only be replaced using a tool.

The deficiency of this disclosed prior art arrangement is that when using large, heavy rollers, for purposes of improving fixing quality, it is difficult to replace and carry the fixing/heating roller by a single central carrying handle without jamming and damaging of the bearing points. Removing a heavy, hot fixing/heating roller and depositing it on a resting surface cannot be done without endangering the service personnel and damaging the roller, since when the roller is laid down it lies directly on the resting surface and can roll away. Furthermore, due to the alignment of the input/output openings of the machine-side U-shaped bearing points, which alignment deviates from the vertical, it is very difficult to insert a large, heavy roller using the central carrying handle, since the roller must be swiveled around the carrying handle to be inserted into the bearing points. Moreover, for purposes of replacing the pressure roller the disclosed embodiment and arrangement of the carrying handle could not be used since the carrying handle would project into an area of the transport path for the toner image-bearing sheets.

SUMMARY OF THE INVENTION

Therefore it is an important purpose of the invention to provide a device which overcomes these defects, and which makes it safer and easier to carry out customer service of the copying machine, especially the replacement of heavy and large rollers, and moreover has a simple, compact, economical structure.

The purpose of the invention is achieved with a device wherein rollers have on their two axial ends one carrying handle each, as the carrying mechanism, which handles are located eccentrically to the center axis of the roller. Accordingly the roller hangs down vertically underneath the carrying handles due to its weight in the manual removal from and insertion into the vertically and radially oriented input/output openings of the bearing points of the copying machine. Advantageously, the carrying handles are attached using annular mechanisms to annular pivot bearings which are concentrically located rigidly on the shaft ends of the roller, and the carrying handles of the roller project in the axial direction beyond their bearing points in the machine. Furthermore, the two attachment mechanisms of the carrying handles are axially and radially centered, guiding and holding of the roller in its machine bearing points; and the two attachment mechanisms of the carrying handles aid in depositing the roller which has been removed from the bearing points on the machine on a resting surface.

Advantageously the carrying handles are attached using annular means to annular pivot bearings which are concentrically located rigidly on the shaft ends of the roller, and the carrying handles of the roller project in the axial direction beyond their bearing points in the machine.

Furthermore, the two attachment means of the carrying handles have means for axial and radial centering, guiding and holding of the roller in its machine bearing points; and the two attachment means of the carrying handles have means for depositing the roller which has been removed from the bearing points on the machine on a resting surface.

Moreover the mechanism for centering, guiding and holding the roller are essentially annular disks which are located concentrically around the shaft ends of the roller. The outside diameter of the disks is greater than that of the roller; and the means for depositing the roller are made as a flattened area on the outside periphery of the annular disk of the means on the bottom side opposite the carrying handles, the flattened area with its support surface projecting by a predetermined amount beyond the outside diameter of the roller.

The invention, and its objects and advantages, will become more apparent in the detailed description of the preferred embodiment presented below.

DETAILED DESCRIPTION OF THE INVENTION

The following description referring to FIGS. 1 to 4 relates to one preferred embodiment of the device according to the invention for manual replacement and deposition of the roller of a copying machine. The device here is located on the pressure roller of a machine or a fixing unit, the fixing unit being located in a copying machine of the conventional type which is not shown. For one skilled in the art in this field it goes without saying that the inventive device can also be used in other machines, such as in printers, image transfer units, photoprinters with fixing units and sheet/strip conveyor units or in sheet sorters with sheet conveyor units and that the rollers can also be made in the form of fixing/heating, image transfer or sheet conveyor rollers.

The device here is located on the pressure roller of a machine or a fixing unit, the fixing unit being located in a copying machine of the conventional type which is not shown, for example, a copier.

For one skilled in the art in this field it goes without saying that the inventive device can also be used in other machines, such as in printers, image transfer units, photoprinters with fixing units and sheet/strip conveyor units or in sheet sorters with sheet conveyor units and that the rollers can also be made in the form of fixing/heating, image transfer or sheet conveyor rollers.

Figure 1:
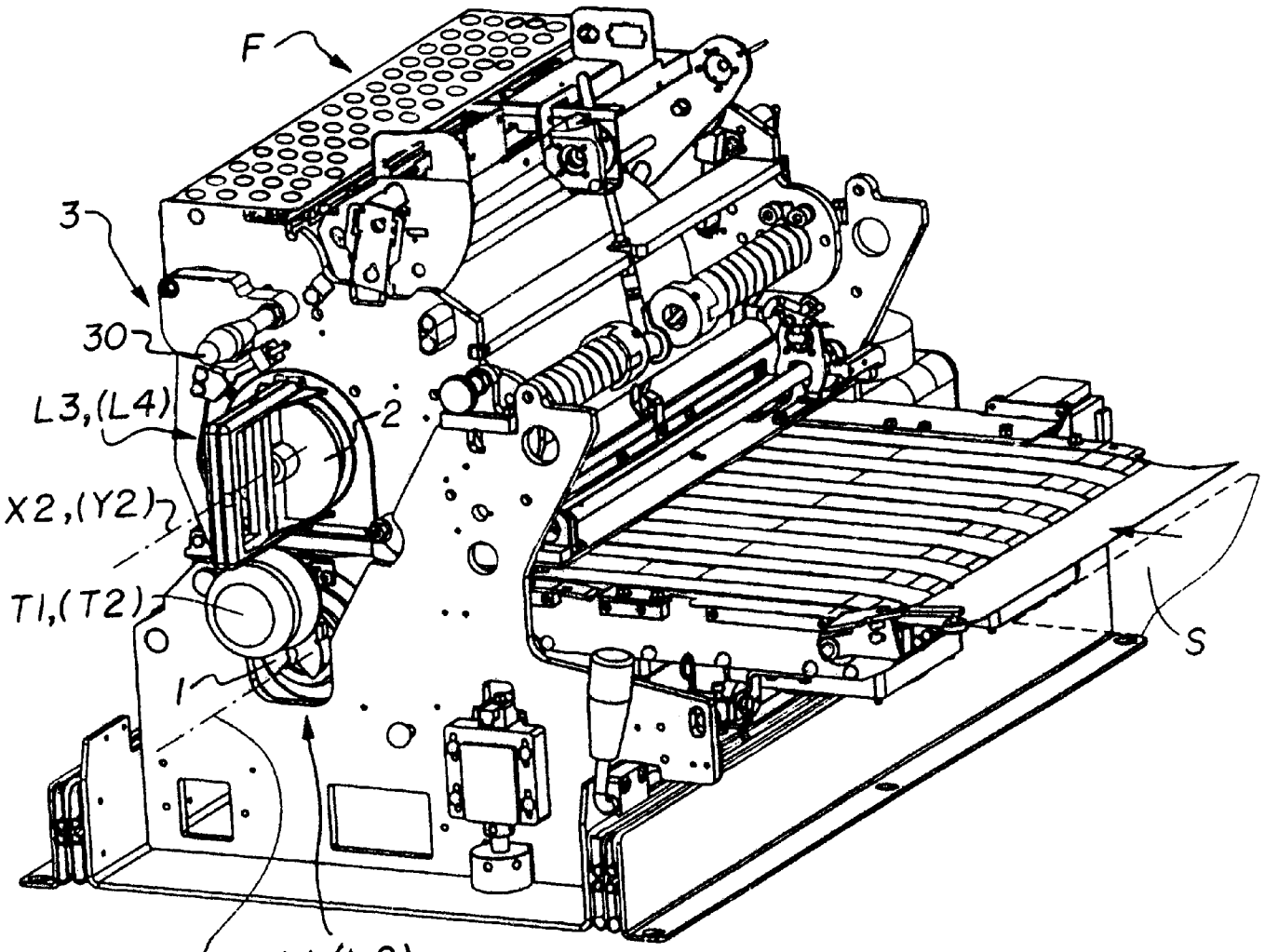
FIG. 1 shows the device according to the invention on the pressure roller of a fixing unit which has been opened and removed from a copying machine, in a three-dimensional representation.

The fixing unit F which is shown in FIG. 1 is shown in the position removed laterally from the copier, on a carriage of the conventional type (which is not shown) and in a closed position. A pressure roller 1, or first lower roller, and fixing roller 2, or second upper roller, are pressed radially against one another. The fixing unit F pressure roller 1 in the lower part of the chassis and fixing roller 2 in the upper part of the chassis are in a roller pair arrangement for routing through and conveying a recording medium S in the form of a sheet or strip. The rollers are supported with their axial ends in bearing points L1; L2; L3; L4 of the chassis parts, to be able to operate by rotation, in the closed position of the fixing unit in an adjoining, axially parallel arrangement.

A manually activated mechanism 3 is provided to swivel the upper chassis part of the fixing unit F or to separate the rollers 1; 2 in the radial direction into the open position of the fixing unit and to release/fix them, for purposes of removal of the pressure roller 1 from its bearing points L1; L2 and/or insertion into them. The manually activated means 3 includes a toggle lever unit with a handle and with an actuating lever 30. The pressure roller 1 is equipped with carrying mechanisms T1; T2, which each have conventional pivot bearings in which the pressure roller is mounted to be able to turn freely around its center axis X1. Furthermore, the pressure roller 1 is equipped with a heating lamp H (see FIG. 3) which is attached centered in it for purposes of its heating. The pressure roller 1, as shown in FIGS. 1 to 4, has on its two axial ends as the carrying mechanism carrying handles T1; T2. Each handle is located eccentrically with respect to the center axis X1 of the roller 1, such that the roller hangs down vertically underneath the carrying handles, due to its weight, in manual removal from and insertion into the input/output openings of the bearing points of the machine F, which openings run vertically and radially.

Figure 2:
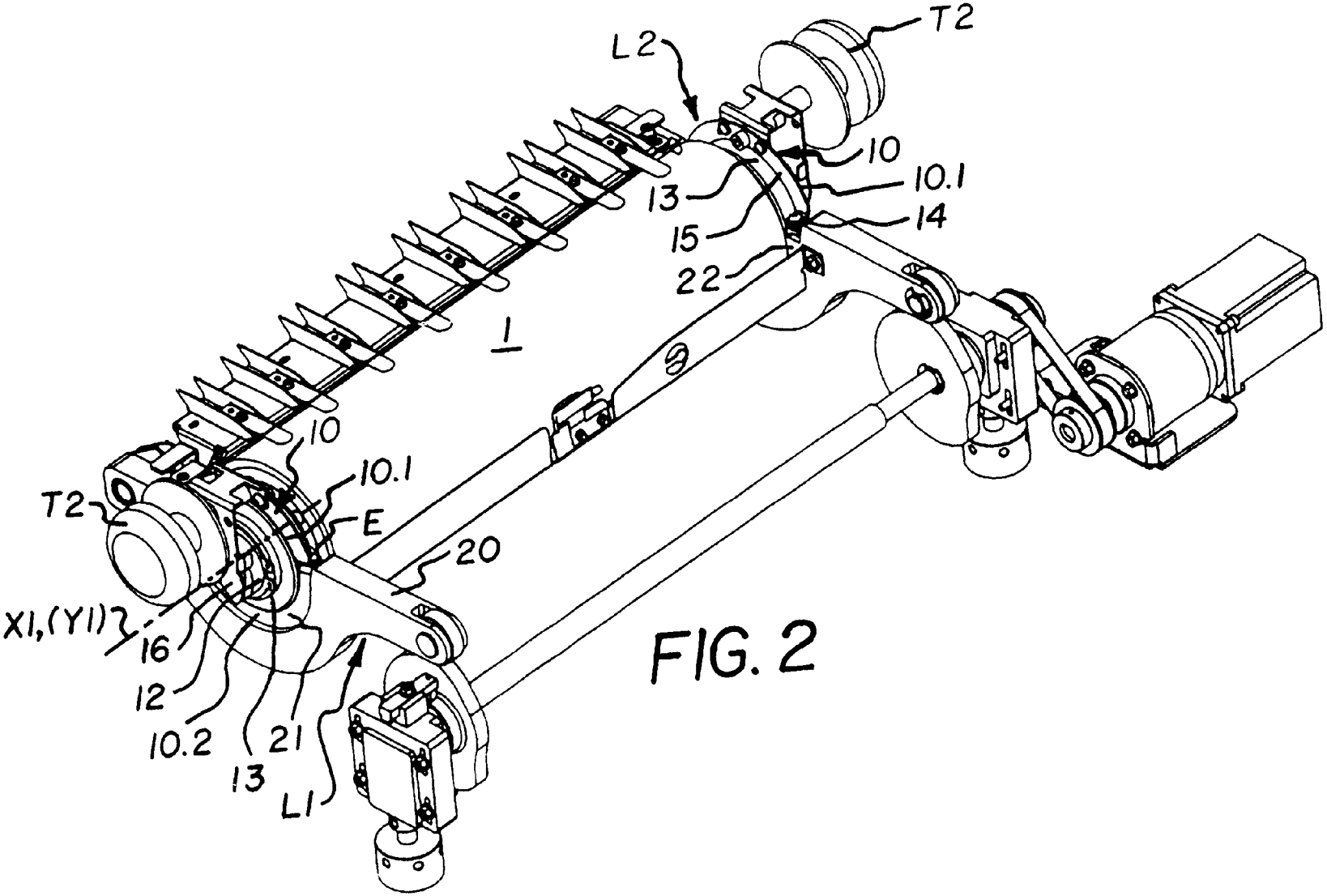
FIG. 2 shows the device from FIG. 1 on a pressure roller which has been released from the fixing unit, in an enlarged three-dimensional view.
Figure 3:
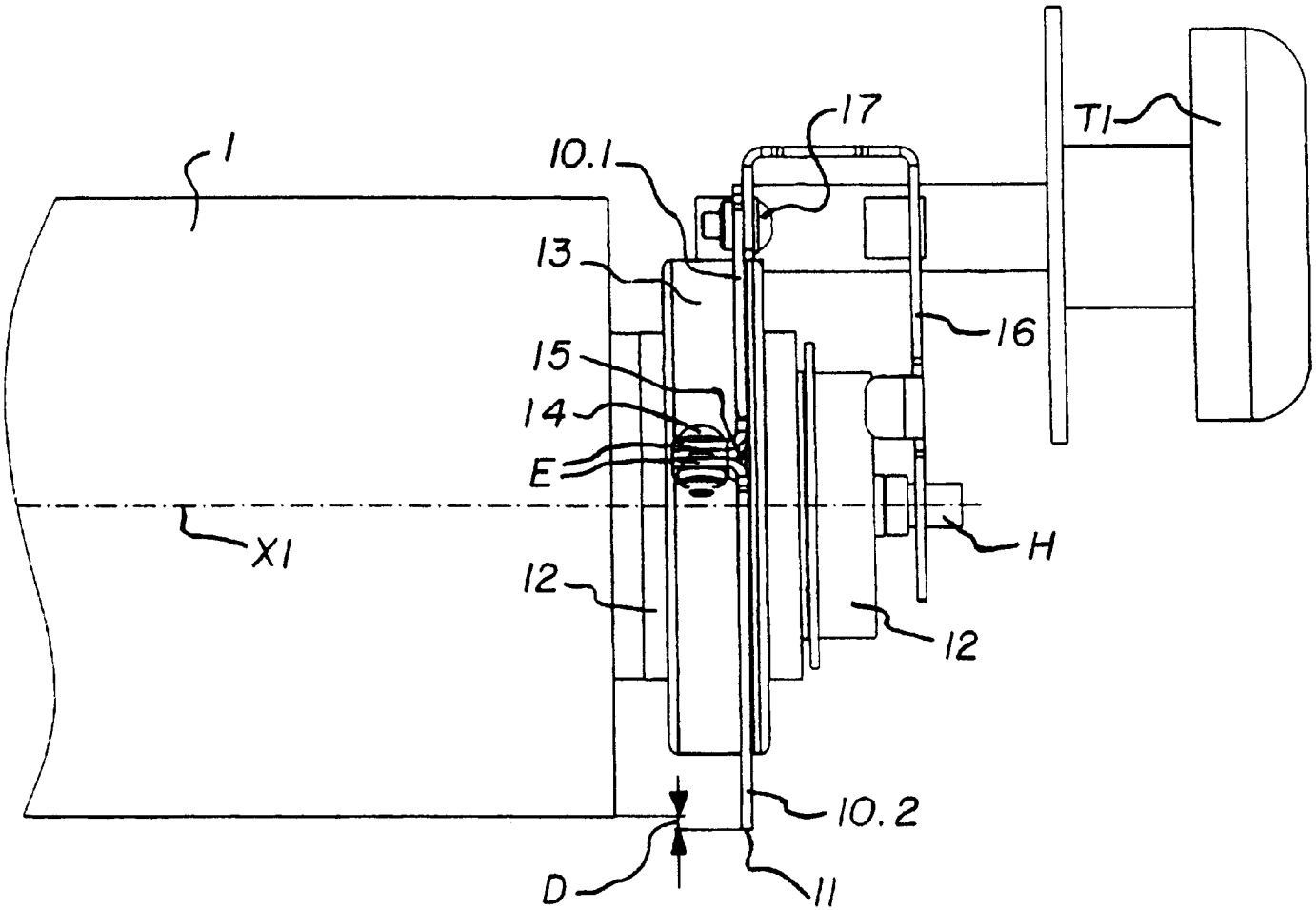
FIG. 3 shows the device from FIG. 2 as an enlarged partial representation in a front view.
Figure 4:
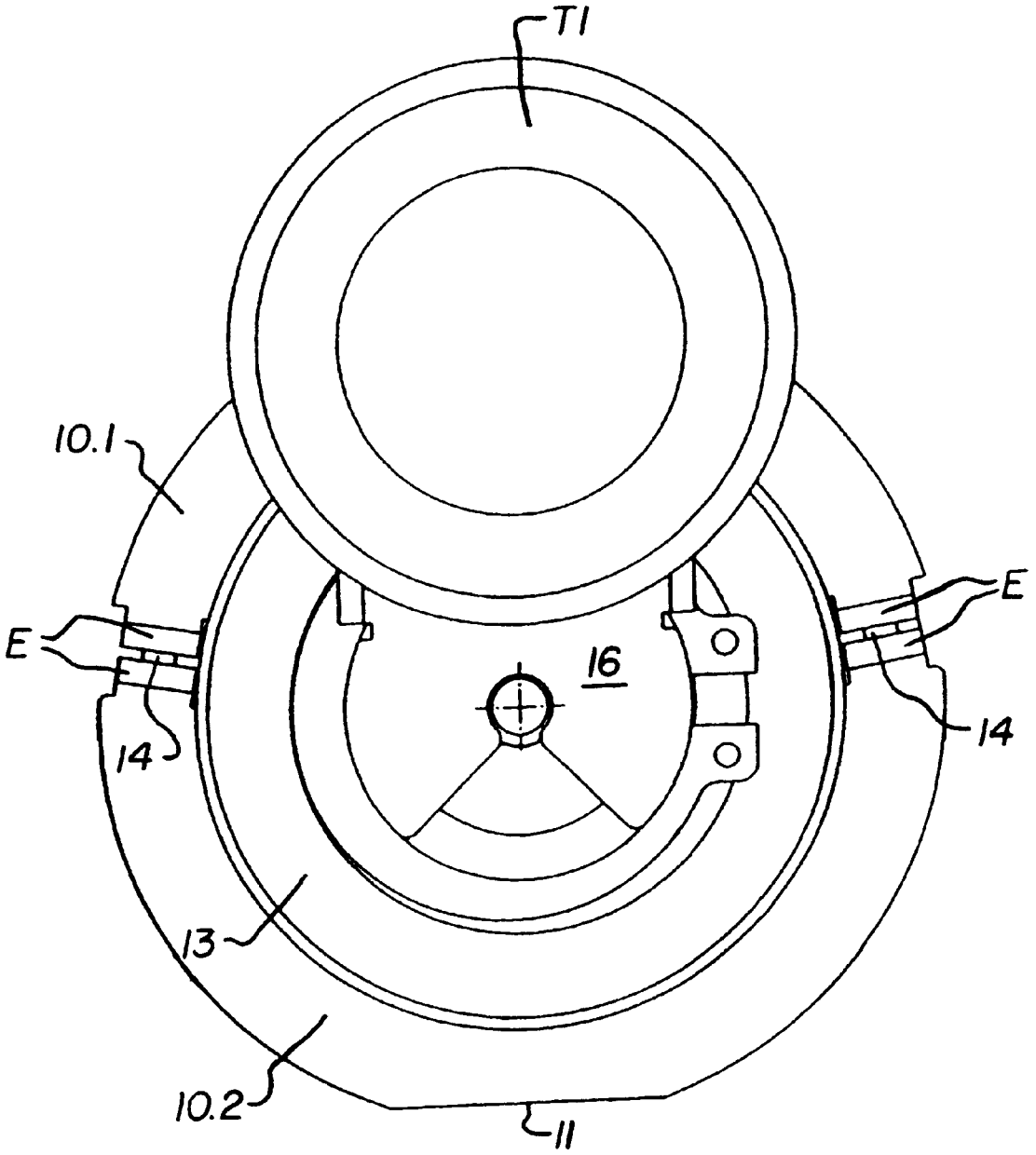
FIG. 4 shows the device from FIG. 3 in a side view.

As shown in FIGS. 2 to 4, the carrying handles T1; T2 are attached by annular members 10; 11 to annular pivot bearings 13. The pivot bearings 13, concentrically located rigidly on the two shaft ends 12 of the pressure roller 1, are for example conventional ball bearings or roller bearings pressed onto the two shaft ends on the outside periphery. The annular members 10; 11 are spaced axially to the pressure roller. The attachment annular members 10; 11 of the carrying handles T1; T2 provide respectively for axial and radial centering, guiding and holding of the pressure roller 1 in its machine bearing points L1; L2, and for depositing the pressure roller 1 which has been removed from the bearing points L1; L2 of the machine or the fixing unit F on a conventional resting surface which is not shown.

The annular members 10 for centering, guiding and holding of the pressure roller 1, as shown in FIGS. 3 and 4, essentially annular disks which are arranged concentrically around the shaft ends 12 of the roller, and which have an outside diameter which is larger than that of the pressure roller 1. The annular members 11 for depositing the pressure roller 1 are flattened areas on the outside circumference of the annular disks the annular members 10. On the bottom side of the flattened area, which is opposite the carrying handles T1; T2, the flattened area, with its flat support surface, projects by a predetermined amount D beyond the outside diameter of the roller. Accordingly, when the pressure roller 1 is deposited on a resting surface, for example a table top, the pressure roller 1 with its outside circumference does not touch the resting surface and cannot roll away due to the flattened area.

Each annular disk 10 of the two attachments annular members 10; 11 has essentially two ring halves 10.1; 10.2. The ends E of the two ring halves are bent at a right angle for joining the ring halves to one another such that the carrying handles T1; T2 can be aligned and fixed to the essentially slotted input/output openings of the bearing points L1; L2 of the fixing unit F. Such openings run from top to bottom radially from the outside circumference to the center axis Y1, when the pressure roller 1 is inserted from overhead into the bearing points L1; L2 of the device F. To do this the bent ends E of the ring halves 10.1; 10.2 fixed on the pivot bearings 13, which ends are connected among one another by connecting elements 14 (for example screws) rest on radial stops/supports 22 in the bearing points L1; L2. As shown in FIG. 2, the two attachment annular members 10; 11 of the carrying handles T1; T2 are held radially and axially centered by the inside peripheral area of their annular disks, or ring halves 10.1; 10.2, in a groove 15 which runs around the outside periphery of the assigned annular pivot bearing 13, and are fixed rigidly on the pivot bearings 13 by the screws 14 which are screwed in on the bent ends of the ring halves. Furthermore, for the pressure roller 1 inserted into the fixing unit F, the two attachment annular members 10; 11 of the carrying handles T1; T2 can be held radially and axially centered by the outside peripheral area of their annular disks and the lower ring halves 10.2 in a groove 21. The groove 21 runs around the inside periphery of the assigned semicircular bearing points L1; L2, especially the inside periphery of the essentially semicircular or U-shaped bearing clips 20 of the bearing points. The ends E of the lower ring halves 10.2 encompass roughly 200 degrees angle at the circumference lying on the stops 22, and are offset axially to the groove 21 in the direction of the roller.

The carrying handles T1; T2 of the pressure roller 1, as shown in FIGS. 1 to 4, are rigidly attached to the upper area of the upper ring halves 10.1 offset radially to the center axis X1 of the pressure roller by connecting element 17, for example, two screws. For improved handling of the pressure roller 1 during replacement by an operator and for formation of a free area above the roller the carrying handles, in the form of essentially cylindrical knobs, are arranged such that they project in the axial direction to the outside beyond their bearing points L1; L2 of the machine or the fixing unit F. To keep the rod-shaped heating lamp H in the center of the hollow pressure roller 1, and to shield the carrying handles T1; T2 against the thermal radiation of the heating lamp, on the two axial ends of the pressure roller 1, one lamp holders

16 is externally connected to each of the upper ring halves 10.1 of the carrying handle attachment annular member 10. Each lamp holder i6 is in the form of a Z-shaped sheet metal angle. The lamp holders 16 have circular openings with V-shaped, elastic insertion slots for holding or clamping the axial ends of the heating lamp.

The invention has been described in detail with particular reference to certain preferred embodiment thereof, but it will be understood that variations and modifications can be effected within the spirit and scope of the invention.

L1 first bearing point/s for 1st roller (pressure roller) in the fixing unit L2 second bearing point/s for 1st roller (pressure roller) in the fixing unit L3 first bearing point/s for 2nd roller (fixing/heating roller) in the fixing unit L4 second bearing point/s for 2nd roller (fixing/heating roller) in the fixing unit D distance between the outside circumference of the 1st roller and the support surface of the lower ring half of the attachment means/annular disks for the carrying handle E bent ends on the ring halves of the attachment means of the carrying handles F fixing unit H heating lamp of 1st roller (pressure roller)

S recording medium/sheet or strip (paper, film, etc.)

T1 first carrying handle/s of carrying means of the 1st roller

T2 second carrying handle/s of carrying means of the 1st roller

X1 center axis of 1st roller

X2 center axis of 2nd roller

Y1 center axis of the bearing point for the 1st roller

Y2 center axis of the bearing point for the 2nd roller

Z swiveling axis of the top and bottom chassis parts of the fixing unit

1 first/bottom roller (pressure roller) of the fixing unit

2 second/top roller (fixing/heating roller) of the fixing unit

3 means for radially separating (pressing together) the rollers in the fixing unit

10 attachment means/annular disk for carrying handle/s on the 1st roller and means for axial/radial centering, guiding, and holding of the 1st roller in the bearing points of the fixing unit

10.1 first/top ring half of the attachment means

10.2 second/bottom ring half of the attachment means

11 means for depositing the 1st roller (radial flattened area on the second lower ring half of the attachment means/annular disk)

12 shaft end of the 1st roller

13 pivot bearing on the shaft end of the 1st roller

14 connecting element (screw) for the ring half

15 groove on the outside periphery of the pivot bearing for attachment means (ring halves)

16 lamp holder on the attachment means for the carrying handle

17 connecting element (screw) for the carrying handle on the attachment means

20 bearing clip for the 1st roller (pressure roller)

21 groove on the inside periphery of the bearing clip for the attachment means (lower ring half)

22 stop/support for the angled ends of the ring halves on the bearing clip

30 actuating lever of the separating means/swiveling means for the rollers

What is claimed is:

1. In a copying machine having rollers in a roller pair arrangement for routing through and delivering a recording medium, in the form of a sheet or strip, which rollers can be operated in rotation in an adjoining, axially parallel arrangement in bearing points of said copying machine, and are supported by their axial ends, a device for manual replacement of one of said rollers of said roller pair, said roller being equipped with a carrying mechanism, in which it can turn freely around its center axis, said manual replacement device comprising: a manually activated mechanism for releasing/fixing said rollers in said bearing points and for separating/compressing said rollers in the radial direction for purposes of removing them from and inserting them into said bearing points, said one roller having, on its two axial ends respectively, a carrying handle as the carrying mechanism, said carrying handles being located eccentrically to said center axis of said one roller such that said one roller hangs down vertically underneath said carrying handles due to its weight in the manual removal from and insertion into input/output openings of said bearing points of said copying machine, which openings run vertically and radially.

2. Device as claimed in claim 1, wherein said carrying handles are attached using annular means to annular pivot bearings which are concentrically located rigidly on said axial ends of said roller.

3. Device as claimed in claim 2, wherein said annular means for attachment of said carrying handles have means for axial and radial centering, guiding and holding of said one roller in its said bearing points; and wherein said annular means for attachment of said carrying handles further have means for depositing said one roller, which has been removed from said bearing points of said copying machine, on a resting surface.

4. Device as claimed in claim 3, wherein said means for centering, guiding and holding said one roller are made as substantially annular disks which are located concentrically around said axial ends of said one roller, and the outside diameter of said disks is greater than that of said one roller; and wherein said means for depositing said one roller are made as a flattened area on the periphery of said annular disk on the bottom side which is opposite said carrying handles, said flattened area with its support surface projecting by a predetermined amount beyond the outside diameter of said one roller.

5. Device as claimed in claim 4, wherein each of said annular disks has two ring halves with ends bent at a right angle for joining said ring halves to one another such that said carrying handles can be aligned and fixed to said input/output openings of said bearing points, which openings run from top to bottom radially to said bearing points, when said one roller is inserted into said bearing points.

6. Device as claimed in claim 5, wherein said annular means for attachment of said carrying handles can be held radially and axially centered by the inside peripheral area of said annular disks in a groove which runs around respective annular pivot bearings, and can be connected using connection elements and can be fixed rigidly on said pivot bearings.

7. Device as claimed in claim 5, wherein said annular means for attachment of said carrying handles can be held radially and axially centered by the outside peripheral area of said annular disks in a groove which runs around respective semicircular bearing points.

8. Device as claimed in claim 7, wherein said carrying handles of said one roller project in the axial direction beyond said bearing points; and said carrying handles are cylindrical knobs.

* * * * *